US007886835B2

(12) United States Patent
Arumugam et al.

(10) Patent No.: US 7,886,835 B2
(45) Date of Patent: Feb. 15, 2011

(54) HIGH ANGLE WATER FLOOD KICKOVER TOOL

(75) Inventors: Arunkumar Arumugam, Missouri City, TX (US); Tyson Messick, Bartlesville, OK (US); Steven Anyan, Missouri City, TX (US); Kenneth C. Burnett, III, Bartlesville, OK (US)

(73) Assignee: Schlumberger Technology Corporation, Sugarland, TX (US)

( * ) Notice: Subject to any disclaimer, the term of this patent is extended or adjusted under 35 U.S.C. 154(b) by 449 days.

(21) Appl. No.: 11/848,838

(22) Filed: Aug. 31, 2007

(65) Prior Publication Data

US 2009/0056954 A1 Mar. 5, 2009

(51) Int. Cl.
*E21B 23/03* (2006.01)
*E21B 23/00* (2006.01)

(52) U.S. Cl. ..... 166/386; 166/381; 166/378; 166/117.5

(58) Field of Classification Search ..... 166/378, 166/381, 386, 72, 117.5
See application file for complete search history.

(56) References Cited

U.S. PATENT DOCUMENTS

| | | | | |
|---|---|---|---|---|
| 2,892,415 | A | | 6/1959 | McGowen, Jr. |
| 2,914,078 | A | | 11/1959 | McGowen, Jr. |
| 3,086,593 | A | | 4/1963 | Chitvvood |
| 3,741,299 | A | | 6/1973 | Terral |
| 3,760,832 | A | | 9/1973 | McGowen, Jr. |
| 3,788,397 | A | | 1/1974 | Terral et al. |
| 3,874,445 | A | | 4/1975 | Terral |
| 3,891,032 | A | | 6/1975 | Tausch et al. |
| 3,958,633 | A | | 5/1976 | Britch et al. |
| 4,002,203 | A | | 1/1977 | Terral |
| 4,111,608 | A | | 9/1978 | Elliott |
| 4,169,505 | A | | 10/1979 | Neal |
| 4,239,082 | A | | 12/1980 | Terral |
| 4,294,313 | A | | 10/1981 | Schwegman et al. |
| 4,375,237 | A | * | 3/1983 | Churchman ..... 166/117.5 |
| 4,441,519 | A | | 4/1984 | Terral |
| 4,454,913 | A | | 6/1984 | Guidry et al. |
| 4,541,482 | A | | 9/1985 | Johnston |
| 4,640,350 | A | | 2/1987 | Akkerman |
| 4,865,125 | A | | 9/1989 | De Cuir |
| 4,976,314 | A | | 12/1990 | Crawford et al. |

(Continued)

FOREIGN PATENT DOCUMENTS

| | | | |
|---|---|---|---|
| GB | 2244504 | A | 12/1991 |

(Continued)

*Primary Examiner*—Shane Bomar
*Assistant Examiner*—Brad Harcourt
(74) *Attorney, Agent, or Firm*—Kevin B. McGoff; Rodney V. Warfford

(57) ABSTRACT

A kickover tool is for placing and extracting a valve in a mandrel having a tool body extending in a longitudinal direction and having a hydraulic piston chamber therein. A hydraulic piston is located inside the hydraulic piston chamber. A kickover arm portion is mechanically connected to the hydraulic piston, the kickover arm portion comprising a kickover arm having a tool portion. The kickover arm has a non-kicked-over position where the kickover arm is substantially coaxial with the longitudinal direction and a kicked-over position where the kickover arm is substantially non-coaxial with the longitudinal direction. The kickover arm moves to the kicked-over position upon extension of the hydraulic piston.

16 Claims, 4 Drawing Sheets

U.S. PATENT DOCUMENTS

| | | | |
|---|---|---|---|
| 5,022,427 | A | 6/1991 | Churchman et al. |
| 5,048,610 | A | 9/1991 | Ross et al. |
| 5,113,939 | A | 5/1992 | Ross et al. |
| 5,483,988 | A | 1/1996 | Pringle |
| 5,515,880 | A | 5/1996 | Pringle |
| 5,862,859 | A | 1/1999 | Speed |
| 5,971,004 | A | 10/1999 | Pringle |
| RE36,566 | E | 2/2000 | Pringle |
| 6,068,015 | A | 5/2000 | Pringle |
| 6,070,608 | A | 6/2000 | Pringle |
| 6,082,455 | A | 7/2000 | Pringle |
| 6,148,843 | A | 11/2000 | Pringle |
| 6,206,645 | B1 | 3/2001 | Pringle |
| 6,231,312 | B1 | 5/2001 | Pringle |
| 6,305,402 | B2 | 10/2001 | Pringle |
| 6,516,890 | B1 | 2/2003 | Jackson et al. |
| 6,776,240 | B2 | 8/2004 | Kenison et al. |
| 6,915,848 | B2 | 7/2005 | Thomeer et al. |
| 2006/0137881 | A1 | 6/2006 | Schmidt et al. |
| 2007/0267200 | A1 | 11/2007 | Jackson et al. |

FOREIGN PATENT DOCUMENTS

| | | | |
|---|---|---|---|
| GB | 2407335 | A | 4/2005 |

* cited by examiner

HIGH ANGLE WATER FLOOD KICKOVER TOOL

TECHNICAL FIELD

The present application generally relates to tools (e.g., kickover tools) for placement and removal of valves from side pocket mandrels.

BACKGROUND

The present application relates to valves such as waterflood/Injection valves, gas lift valves (IPO Injection pressure operated and PPO Production pressure operated), chemical injection valves, shear orifice valves, orifice valves and dummy valves.

One of those, gas lift valves, are used to artificially lift oil from wells where there is insufficient reservoir pressure to produce the well. The associated process involves injecting gas through the tubing-casing anulus. Injected gas aerates the fluid to make the fluid less dense; the formation pressure is then able to lift the oil column and forces the fluid out of the wellbore. Gas may be injected continuously or intermittently, depending on the producing characteristics of the well and the arrangement of the gas-lift equipment.

A mandrel is a device installed in the tubing string of a gas-lift well onto which or into which a gas-lift valve is fitted. There are two common types of mandrel. In one conventional gas-lift mandrel, the gas-lift valve is installed as the tubing is placed in the well. Thus, to replace or repair the valve, the tubing string must be pulled. The second type is a sidepocket mandrel where the valve is installed and removed by wireline while the mandrel is still in the well, eliminating the need to pull the tubing to repair or replace the valve.

With the sidepocket mandrel, the gas lift valves are replaced with a kickover tool. The Kickover tool is lowered into wells to place and remove gas lift valves. Normally, a kickover tool is lowered downhole by wireline. A kickover arm of the kickover tool is actuated mechanically to actuate the kickover arm.

Existing kickover tools are generally intended for use in relatively vertical wells, i.e., wells with a deviation not more than about 45 degrees. Those designs are usually delivered by wireline. However, those designs have limited use in more horizontal wells that are prevalent now. Additionally, there are drawbacks associated with mechanical actuation of the kickover arm and the wireline deployment technique. Thus, there is a need for a kickover tool that will perform well in all situations and provide benefits in wells that are more horizontal.

The present application describes designs that address those issues and limitations associated with mechanically actuated kickover tools that are deployed by wireline in vertical holes.

SUMMARY

A non-limiting embodiment of the invention includes a tool for inserting and removing a valve in a downhole mandrel. A body extends in a longitudinal direction and has a first end and a second end. A hydraulic chamber is within the body and extends from the first end. The first end and the hydraulic chamber are hydraulically connectable to coiled tubing. A piston chamber is inside the body, the piston chamber extending from a second end of the body and being hydraulically connected to the pressure chamber. A piston is slidably located within the piston chamber. An actuation device is connected to the piston. The actuation device comprises a first actuation part having a first position and a second position. A second actuation part has a first position with reference to the first actuation part and a second position with reference to the first actuation part. The piston mechanically connects with the second actuation part. The first actuation part is connected with the piston by way of the second actuation part. Upon actuation and movement of the piston with respect to the first actuation part, the second actuation part moves with respect to the first actuation part thereby placing the second actuation part in the second position. The actuator device is mechanically connected to a kickover arm device. The kickover arm device has a non-kicked-over position and a kicked-over position. When the second actuation part is in the first position, the kickover arm device is prevented from moving from the non-kicked-over position to the kicked-over position, and when the second actuation part is in the second position, the kickover arm tool is allowed to move from the non-kicked-over position into the kicked-over position.

DETAILED DESCRIPTION

In the following description, numerous details are set forth to provide an understanding of the present invention. However, one skilled in the art will understand that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

As noted above, this application applies to kickover tools for use in connection with at least waterflood/Injection valves, gas lift valves (IPO Injection pressure operated and PPO Production pressure operated), chemical injection valves, shear orifice valves, orifice valves and dummy valves.

Figure 1:
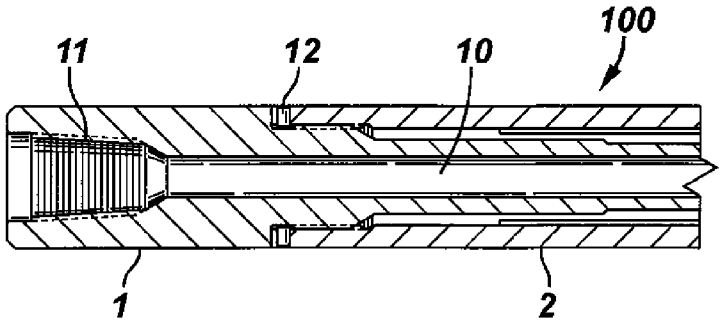
FIG. 1 shows a portion of a kickover tool.

FIG. 1 shows a first end of the kickover tool 100. The main body of the kickover tool 100 includes a first part 1. The first part 1 includes therein a pressure chamber 10 that extends along a longitudinal axis within the kickover tool 100. The longitudinal axis is illustrated as the center line extending there through. The first part 1 includes a female toothed region 11 that connects with a corresponding part of coiled tubing (not shown). The coiled tubing can provide pressure to the pressure chamber 10. Tubing other than coiled tubing can be used instead, e.g., piping or other materials. Wireline can also be used, and pressure in the chamber can be generated by a spring chamber or a nitrogen chamber. The spring chamber or nitrogen chamber could be actuated mechanically or by hydraulic pressure transmitted through the coiled tubing. Many attachment configurations can be used such as clamping, bolting or welding. Other gas type chambers can be used in place of the nitrogen chamber. The first part 1 connects to a second part 2. The first part 1 and the second part 2 can be secured to one another by one or more bolts 12. The first part 1 and the second part 2 could be replaced by a single unitary part or multiple parts.

Figure 2:
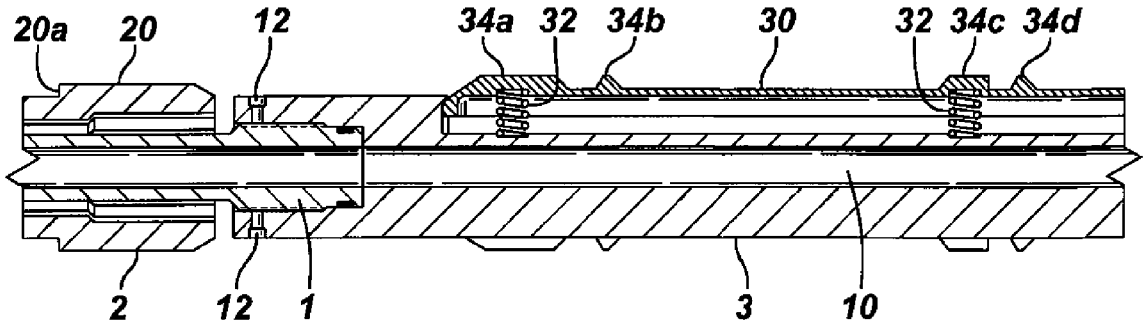
FIG. 2 shows a portion of the kickover tool to the right of the portion shown in FIG. 1.

FIG. 2 shows a portion of the kickover tool 100 to the right of the portion shown in FIG. 1. The second part 2 includes a snap lock portion 20. The snap lock portion 20 extends from the second part 2 in a radial direction and is moveable in and out in the radial direction. The in/out movement is achieved by spring action of the second part 2. The in/out motion can also be from hydraulic pressure, e.g., from the pressure chamber 10. The snap lock portion 20 has a stepped portion 20*a* that is configured to abut a corresponding surface in a landing coupling portion of a downhole mandrel to provide a locking force in the uphole axial direction. The snap lock portion 20 also provides placement guidance for the kickover tool. An extension of the first part 1 connects to a third part 3. The first part 1 and the third part 3 are shown as separate parts but could be a single unitary part or multiple parts. The first part 1 and the third part 3 can be secured to one another by one or more bolts 12. The third part 3 includes an extension of the pressure chamber 10. The third part 3 also includes a locator key part 30. The locator key part 30 is supported on the third part 3 by springs 32 that provide bias in the radial direction and allows the locator key part 30 to move in/out in the radial direction. The locator key part has protruding portions 34*a*, 34*b*, 34*c*, 34*d*, 34*e* and 34*f* that are formed in a predetermined pattern. There can be more or fewer protruding portions than shown. The pattern of protruding portions 34*a*, 34*b*, 34*c*, 34*d*, 34*e* and 34*f* is designed to match a corresponding pattern of recesses on an inside surface of a landing coupling portion of a downhole mandrel to locate the kickover tool 100. That is, the locator key 30 will lock into a mandrel with a proper configuration of recesses, thereby locating the kickover tool 100 properly in the intended mandrel. Though springs 32 are shown, a number of biasing devices could be used including elastomeric materials, cushions, linear springs, etc.

Figure 3:
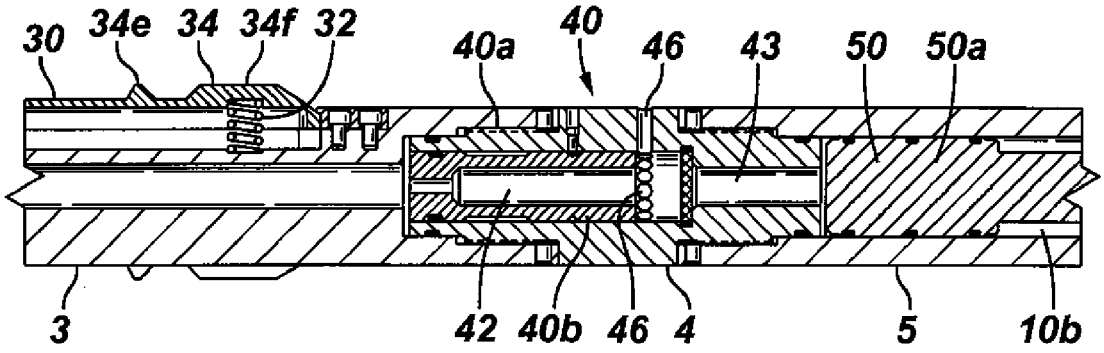
FIG. 3 shows a portion of the kickover tool to the right of the portion shown in FIG. 2.

FIG. 3 shows a portion of the kickover tool 100 that is to the right of the portion shown in FIG. 2. A fourth part 4 is connected with the third part 3. The fourth part 4 and the third part 3 could be a single unitary part or multiple parts. The third part 3 makes up a valve 40 comprising an outer valve portion 40*a* and an inner valve portion 40*b*. The inner valve portion 40*b* is slidably located within the outer valve portion 40*a*. At least one passageway 46 fluidly connects a volume 42 inside the inner valve 40*b* to outside the kickover tool 100. The volume 42 is hydraulically connected with the pressure chamber 10. The inner valve 40*b* has a first position where the inner valve 40*b* is to the left. The inner valve 40*b* has a second position that is to the right. When the inner valve 40*b* is in the first position (to the left) the passageway 46 is open and the volume 42 is hydraulically connected to the outside of the kickover tool 100. When the inner valve 40*b* is in the second position (to the right) the passageway 46 is closed and the volume 42 is not connected to the outside of the kickover tool 100.

One advantage of the configuration described above is an ability to flush out debris that may be present in an inside diameter of a wellbore or completion component. Also, this configuration allows the coiled tubing to be filled by pumping while running in hole (if desired) without building up pressure differential or trapping air in the coiled tubing. Further, the configuration allows circulation to be maintained while running in hole to ensure that the coiled tubing can pump down the coil, which is related to well control reasons. That is, when the inner valve 40*b* is in the first position (to the left) fluid can be forced through the pressure chamber 10 and out the passageway 46 thereby performing the flushing out operation. The valve 40*b* can be moved from the first position (to the left) to the second position (to the right) by increasing the flow of fluid through the volume 42.

FIG. 3 shows a fifth part 5 that is connected with the fourth part 4. The fifth part 5 includes an extension 43 of the pressure chamber 10. The fifth part 5 and the fourth part 4 can be a unitary part or multiple parts. Further, the fifth part 5 includes a hydraulic piston chamber 10*b*. A hydraulic piston 50 is located inside the hydraulic piston chamber 10*b*. A first end of the piston 50*a* is hydraulically connected to the extension 43. As hydraulic pressure increases in the extension 43 pressure is transferred to the end 50*a* of the piston 50. The piston 50 moves within the piston chamber 10*b*.

Figure 4:
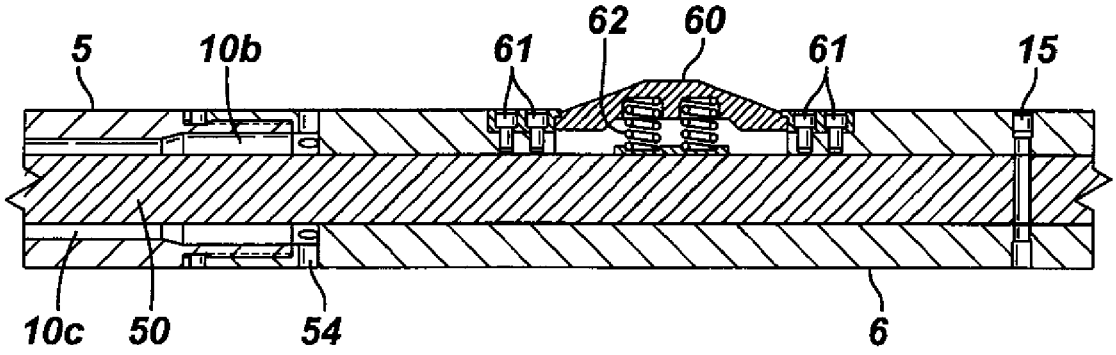
FIG. 4 shows a portion of the kickover tool to the right of the portion shown in FIG. 3.

FIG. 4 shows a portion of the kickover tool 100 that is to the right of the portion shown in FIG. 3. The piston 50 extends within the piston chamber 10*b*. A downhole side 10*c* of the piston chamber is shown. The piston chamber 10*b* is hydraulically connected to outside the kickover tool 100 by way of passageways 54. The fifth part 5 connects with a sixth part 6. The fifth part 5 and the sixth part 6 could be a single unitary part or multiple parts. An orientation key 60 is connected to the surface of the sixth part 6. The orientation key 60 comprises a protruding portion that extends beyond a surface of the sixth part 6. The orientation key 60 can be movable in/out in the radial direction and can be biased by springs 62 in the radial direction. Bolts 61 can be used to secure the orientation key 60. In operation, as the kickover tool 100 is lowered downhole and in proximity to a mandrel, orienting sleeves (FIG. 7) are encountered. The orienting sleeves are angled and contact the orientation key 60 thereby rotating the kickover tool 100 to a proper angle. A downhole direction orienting sleeve can be used, and an uphole orientating sleeve can be used. As the orienting key 60 passes through the downhole orienting sleeve in the downhole direction the kickover tool 100 is rotated. Also, as the orienting key 60 travels through the orienting sleeve in the uphole direction, the kickover tool 100 rotates. That aspect is beneficial because when lowering in the downhole direction, there is potential for the orienting key 60 to contact a "point" of the orienting sleeve and to not achieve rotation. Thus, by lowering the kickover tool 100 and then raising the kickover tool 100 within a mandrel, any chances of the kickover tool 100 being improperly oriented are greatly reduced.

Figure 5:
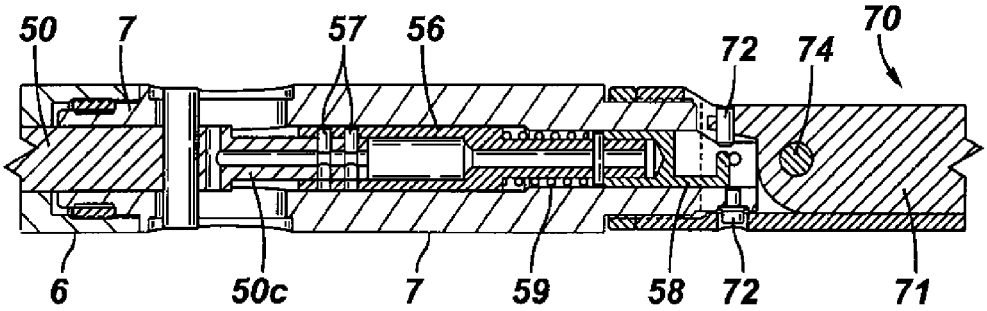
FIG. 5 shows a portion of the kickover tool to the right of the portion shown in FIG. 4.

FIG. 5 shows an extension 50*c* of the piston 50 that extends into a seventh part 7. The piston extension 50*c* connects with and extends into an actuation part 56 that is slidably located inside the seventh part 7. The actuation part 56 is biased to the left by a spring 59. The actuation part 56 is adjacent to another actuation part 58. Shear screws 57 extend from the actuation part 56 into the piston extension 50*c*. The actuation part 58 has a first position that is to the left and a second position that is to the right.

A kickover arm tool 70 is connected with the seventh part 7. The kickover arm tool 71 is rotatable with respect to the seventh part 7 by way of a hinge mechanism 74. Any rotating connection can be made so that the kickover arm 74 is in rotational connection with respect to the seventh part 7. An actuation pin 72 is connected to the kickover arm 71 and is positioned so that when the actuation part 58 is in the first position (to the left) the pin 72 is adjacent to the actuation part 58 thereby preventing counterclockwise rotation of the kick-over arm 71. When the actuation part 58 moves to the second position (to the right), the kickover arm 71 is no longer prevented from rotating in a counterclockwise direction and moves to the kicked-over position.

Figure 6:
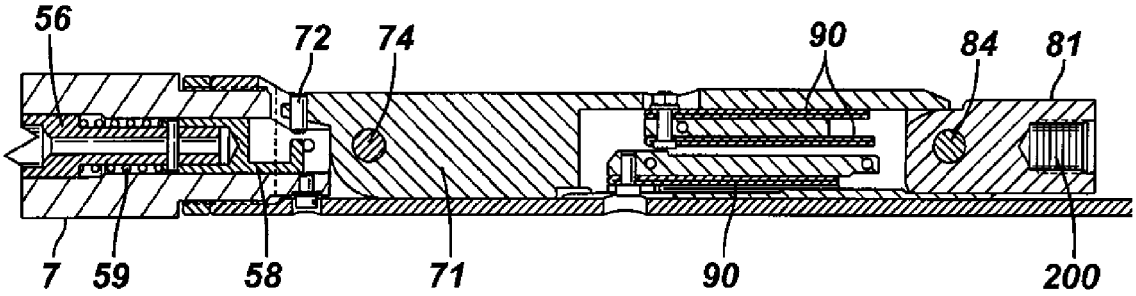
FIG. 6 shows a portion of the kickover tool to the right of the portion shown in FIG. 5.

FIG. 6 shows a portion of the kickover tool 100 further to the right than that shown in FIG. 5. The kickover arm 71 farther to the right, a second kickover arm 81, a valve port 200 and a spring 90 are shown. The spring part 90 provides bias to move the kickover arm 71 and a kickover arm 81 into a kicked-over position once the actuation part 58 moves to the second position (to the right). The force of the springs 90 causes the kickover arm 71 to rotate counterclockwise and the kickover arm 81 to rotate clockwise. The resulting kicked-over configuration leaves the kickover arm 71 at an angle compared to the longitudinal axis of the kickover tool 1 and the kickover arm 81 extending substantially parallel to the longitudinal axis of the kickover tool 100. That configuration leaves the kickover arm 81 in position to enter a side pocket of a mandrel.

Referring back to FIG. 5, as the piston 50 actuates and moves forward, due to the shear pins 57, the actuation part 56 is moved forward toward the second actuation part 58. Once the second actuation part 56 is moved into the second position, the kickover arms 71, 81 move to the kicked-over position. Upon further actuation of the piston 50 the seventh part 7 is moved with the piston 50 to an extended position thereby locating the second kickover arm 81 and the valve port 200 (with valve in actual use) into a side pocket mandrel, where the valve (not shown) is either placed or removed into/from the side pocket mandrel.

Figure 7:
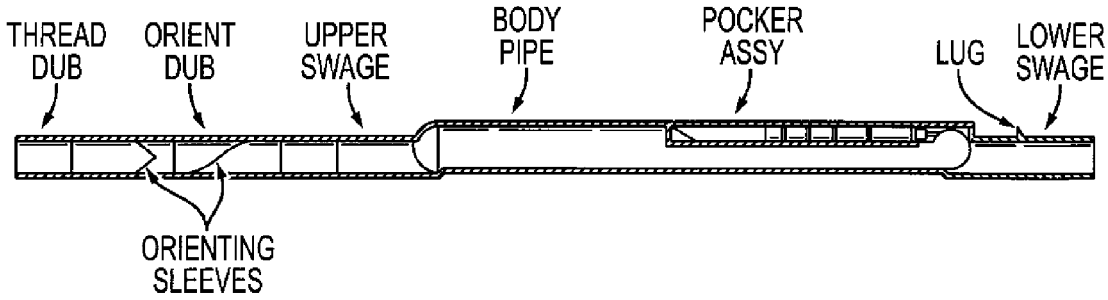
FIG. 7 shows a side view of a mandrel.

FIG. 7 shows a side view of a cross section of a mandrel. A downhole orienting sleeve and an uphole orienting sleeve are shown. As noted earlier, the downhole orienting sleeve and the uphole orienting sleeve can each interact with the orientation key 60. The body pipe includes a pocket assay wherein the valve is located. The mandrel is connected to production tubing at the thread sub.

Figure 8:
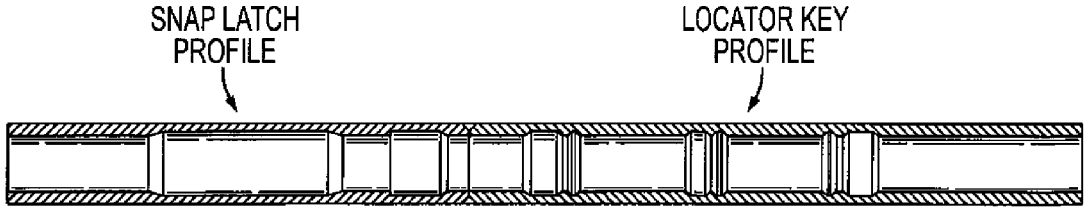
FIG. 8 shows a landing coupling portion.

FIG. 8 is a closer view of a portion of the mandrel, focusing on the snap latch profile and the locator key profile. The snap latch profile interacts with the snap lock portion 20. The locator key profile interacts with the locator key part 30.

The previous description mentions a number of devices, including mandrels and valves. Detailed specifications for both are available at www.slb.com (Schlumberger's website) and they are available for purchase from Schlumberger.

Also, one should note that this invention is in no way limited to applications concerning the valves noted herein, and can extend to other applications including but not limited to the noted valve applications.

The preceding description is meant to illustrate certain features of embodiments and are not meant to limit the literal meaning of the claims as recited herein.

What is claimed is:

1. A tool for inserting and removing a valve in a mandrel, comprising:

a body that extends in a longitudinal direction and has a first end and a second end, a hydraulic chamber being within the body and extending from the first end, the first end and the hydraulic chamber being hydraulically connectable to coiled tubing;

a piston chamber inside the body, the piston chamber extending from a second end of the body and being hydraulically connected to the pressure chamber, a piston is slidably located within the piston chamber;

an actuation device is connected to the piston, the actuation device comprises:

a first actuation part having a first position and a second position;

a second actuation part having a first position with reference to the first actuation part and a second position with reference to the first actuation part;

the piston mechanically connects with the second actuation part, the first actuation part being connected with the piston by way of the second actuation part;

wherein upon actuation and movement of the piston with respect to the first actuation part, the second actuation part moves with respect to the first actuation part thereby placing the second actuation part in the second position;

the actuator device is mechanically connected to a kickover arm device; and the kickover arm device has a non-kicked-over position and a kicked-over position;

wherein, when the second actuation part is in the first position, the kickover arm device is prevented from moving from the non-kicked-over position to the kicked-over position, and when the second actuation part is in the second position, the kickover arm tool is allowed to move from the non-kicked-over position into the kicked-over position.

2. The tool of claim 1, wherein the body comprises a snap latch portion, the snap latch portion being a movable part that extends from the body part in a radial direction and has a stepped portion, the stepped portion being adapted to abut a face inside a completion part to hold the tool in the longitudinal direction.

3. The tool of claim 1, wherein the body part comprises a locating key section, the locating key section being a movable part that extends from the body part in a radial direction and has protrusions forming a pattern that extends in the radial direction, the pattern of protrusions is adapted to fit a corresponding pattern of recesses in a completion part thereby holding the tool in place in the axial direction.

4. The tool of claim 1, comprising a valve within the piston chamber and a pressure opening on the radial surface of the body connecting the pressure chamber and an area external to the body, the valve opening and closing connection through the pressure opening, the opening and closing being actuated by varying flow through the pressure chamber.

5. The tool of claim 4, wherein the valve is slidable within the pressure chamber, the valve having a first position where the valve is proximal to the first end of the body and a second position where the valve is distal to the first end of the body, and when in the first position communication through the pressure chamber is open and when in the second position communication through the pressure chamber is closed.

6. The tool of claim 1, wherein when in the second position as the piston extends in a direction toward the actuation device, the first actuation part does not move relative to the piston.

7. The tool of claim 1, comprising a shear member that interconnects with the piston thereby preventing movement of the piston, the shear member being sheared upon application of a threshold force to the piston.

8. The tool of claim 1, comprising a shear member that interconnects with the first actuation part thereby preventing movement of the actuation part, the shear member being sheared upon application of a threshold force to the first actuation part.

9. The tool of claim 1, wherein when the kickover arm is in the non-kicked-over position a longitudinal axis of the arm is substantially parallel with a longitudinal axis of the piston and when the kickover arm is in the kicked-over position the longitudinal axis of the kickover arm is substantially non-parallel with the longitudinal axis of the piston.

10. The tool of claim 1, wherein the piston chamber has a first portion with a first diameter and a second portion with a second diameter, the second diameter being smaller than the first diameter;

the piston is slidably located within the piston chamber and has a first end and a second end; and the first end of the piston has a larger diameter than the second diameter of the piston chamber, the first end of the piston is located in the first portion of the piston chamber.

11. The tool of claim 1, wherein the body part comprises an orientation key, the orientation key extending from the body part in a radial direction.

12. A kickover tool for placing and extracting a valve in a mandrel, comprising:

a tool body extending in a longitudinal direction and having a hydraulic piston chamber therein;

a hydraulic piston located inside the hydraulic piston chamber;

a kickover arm portion mechanically connected to the hydraulic piston, the kickover arm portion comprising a kickover arm having a tool portion;

the kickover arm has a non-kicked-over position where the kickover arm is substantially coaxial with the longitudinal direction and a kicked-over position where the kickover arm is substantially non-coaxial with the longitudinal direction;

wherein the kickover arm moves to the kicked-over position upon extension of the hydraulic piston;

the kickover arm portion comprising an actuation part that is mechanically connected to the hydraulic piston so that the actuation part moves axially with and upon movement of the hydraulic piston;

wherein the actuation part has a first position and a second position, the first position preventing the kickover arm from moving to the kicked-over position and the second position allowing the kickover arm to move to the kicked-over position.

13. The kickover tool of claim 12, wherein the actuation part comprises a first actuation part and a second actuation part, the first actuation part being movable with respect to the second actuation part, the second actuation part being mechanically connected to the hydraulic piston.

14. The kickover tool of claim 12, wherein the kickover arm portion can move in the longitudinal direction with reference to the tool body by way of extension and contraction of the hydraulic piston.

15. The kickover tool of claim 12, wherein the kickover arm is biased from the non-kicked-over position to the kicked-over position by springs.

16. A kickover tool for placing and extracting a valve in a mandrel, comprising a tool body extending in a longitudinal direction and having a hydraulic piston chamber therein;

a hydraulic piston located inside the hydraulic piston chamber;

a kickover arm portion mechanically connected to the hydraulic piston, the kickover arm portion comprising a kickover arm having a tool portion;

the kickover arm has a non-kicked-over position where the kickover arm is substantially coaxial with the longitudinal direction and a kicked-over position where the kickover arm is substantially non-coaxial with the longitudinal direction;

wherein the kickover arm moves to the kicked-over position upon extension of the hydraulic piston;

the kickover arm portion comprising an actuation part that is mechanically connected to the hydraulic piston so that the actuation part moves axially with and upon movement of the hydraulic piston;

a valve within the piston chamber and a pressure opening on the radial surface of the body connecting the pressure chamber and an area external to the body, the valve opening and closing a connection through the pressure opening, the opening and closing being actuated by varying flow through the pressure chamber.

* * * * *